US008752522B1

(12) United States Patent
Cohen

(10) Patent No.: US 8,752,522 B1
(45) Date of Patent: Jun. 17, 2014

(54) COMPACT MULTI-UNIT VEHICLE COOLING SYSTEM

(76) Inventor: Asaf Cohen, Ronkonkoma, NY (US)

( * ) Notice: Subject to any disclaimer, the term of this patent is extended or adjusted under 35 U.S.C. 154(b) by 297 days.

(21) Appl. No.: 13/420,249

(22) Filed: Mar. 14, 2012

(51) Int. Cl.
*F01P 3/18* (2006.01)

(52) U.S. Cl.
CPC ..... *F01P 3/18* (2013.01)
USPC ..... 123/195 A; 123/41.31; 123/41.48; 165/41

(58) Field of Classification Search
CPC ..... F01P 3/18; F01P 3/20; F01P 1/06; F01P 11/00; F28F 9/001; F28F 9/002; F28F 9/007
USPC ..... 123/41.31, 41.48, 41.51, 41.56, 195 A, 123/195 R, 198 R, 196 AB; 165/41, 47, 67
See application file for complete search history.

(56) References Cited

U.S. PATENT DOCUMENTS

| | | | | |
|---|---|---|---|---|
| 1,535,904 | A | 4/1925 | Daniels | |
| 3,204,406 | A * | 9/1965 | Howes et al. | 60/39.17 |
| 3,769,947 | A | 11/1973 | Crain | |
| 3,859,817 | A | 1/1975 | Kick | |
| 4,167,969 | A | 9/1979 | Ritzenthaler | |
| 5,901,786 | A * | 5/1999 | Patel et al. | 165/283 |
| 6,591,896 | B1 | 7/2003 | Hansen | |
| 6,622,668 | B2 * | 9/2003 | Izumi | 123/41.49 |
| 6,880,656 | B2 * | 4/2005 | Pfusterschmid et al. | 180/68.4 |
| 6,901,903 | B2 * | 6/2005 | Nakajima et al. | 123/198 E |
| 7,028,751 | B2 * | 4/2006 | Fischer et al. | 165/42 |
| 7,533,635 | B2 | 5/2009 | Bradley | |
| 7,896,062 | B2 * | 3/2011 | Adamson et al. | 165/41 |
| 8,505,499 | B2 * | 8/2013 | Hirasawa et al. | 123/41.31 |
| 8,616,265 | B2 * | 12/2013 | Fell et al. | 165/41 |
| 2002/0152766 | A1 * | 10/2002 | Fischer et al. | 62/428 |
| 2006/0231234 | A1 * | 10/2006 | Kalbacher | 165/44 |
| 2007/0007061 | A1 * | 1/2007 | Meyer et al. | 180/68.1 |
| 2009/0133646 | A1 | 5/2009 | Wankhede | |
| 2011/0073291 | A1 * | 3/2011 | Hu | 165/144 |
| 2011/0127005 | A1 * | 6/2011 | Keerl | 165/51 |

* cited by examiner

*Primary Examiner* — Noah Kamen
*Assistant Examiner* — Grant Moubry
(74) *Attorney, Agent, or Firm* — Jason L. Gilbert

(57) ABSTRACT

A compact multi-unit vehicle cooling system for reducing heat toward the engine of a vehicle. The compact multi-unit vehicle cooling system generally includes a radiator, an air charge cooler, a transmission oil cooler, an engine oil cooler and a power steering oil cooler. Each of the components of the present invention is secured in a compact package for installation in a vehicle such as a HUMMER or the like. By utilizing a modulated, compact design, the present invention may more easily be installed and serviced while significantly reducing heat towards the vehicle's engine and thus increasing horsepower.

18 Claims, 5 Drawing Sheets

COMPACT MULTI-UNIT VEHICLE COOLING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a vehicle cooling system and more specifically it relates to a compact multi-unit vehicle cooling system which includes a compact assembly having a radiator, an engine oil cooler, transmission cooler, air charge cooler and power steering cooler for reducing heat toward the engine of a vehicle.

2. Description of the Related Art

Any discussion of the related art throughout the specification should in no way be considered as an admission that such related art is widely known or forms part of common general knowledge in the field.

Large vehicles for off-roading such as HUMMERS, Humvees and the like have been in use for many years. When operating such vehicles in off-roading conditions or with a heavy load, the engine and other various components thereof have been known to overheat, which can significantly impact the operation and efficiency of the vehicle.

While there have been a number of solutions to the problem of overheating under heavy load, such solutions have been shown to be piecemeal solutions to a larger problem. Further, it is often difficult to install and maintain multiple cooling systems within the same vehicle. It is customary to include at least a transmission cooler in such vehicles, though this does not completely alleviate the problem of overheating under heavy load or stressed conditions.

Because of the inherent problems with the related art, there is a need for a new and improved compact multi-unit vehicle cooling system which includes a compact assembly having a radiator, an engine oil cooler, transmission cooler, air charge cooler and power steering cooler for reducing heat toward the engine of a vehicle.

BRIEF SUMMARY OF THE INVENTION

The invention generally relates to a vehicle cooling package which includes a radiator, an air charge cooler, a transmission oil cooler, an engine oil cooler and a power steering oil cooler. Each of the components of the present invention is secured in a compact package for installation in a vehicle such as a HUMMER or the like. By utilizing a modulated, compact design, the present invention may more easily be installed and serviced while significantly reducing heat towards the vehicle's engine and thus increasing horsepower.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
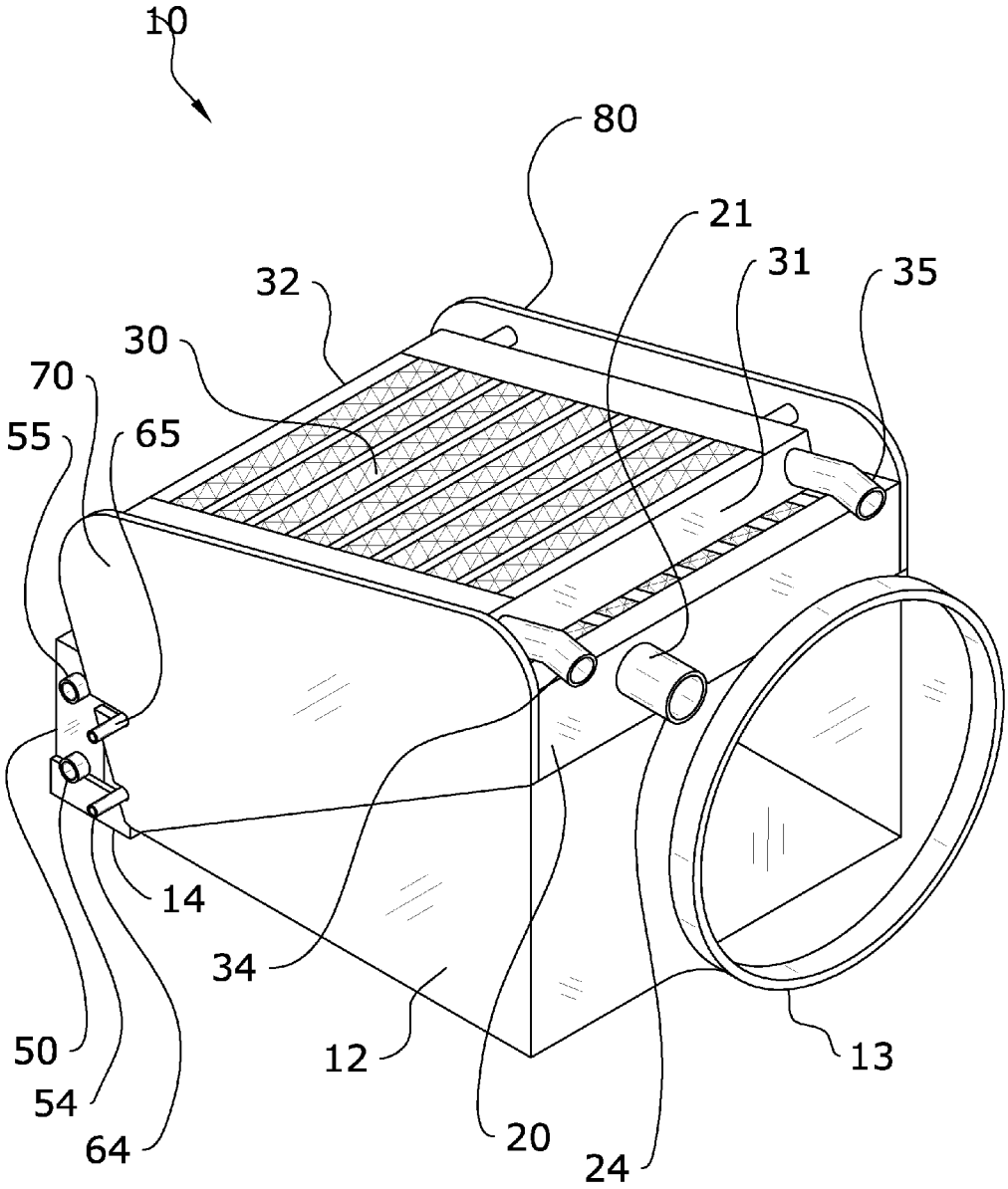
FIG. 1 is a frontal upper perspective view of the assembled present invention.

Turning now descriptively to the drawings, in which similar reference characters denote similar elements throughout the several views, FIGS. 1 through 5 illustrate a compact multi-unit vehicle cooling system 10, which comprises a radiator 20, an air charge cooler 30, a transmission oil cooler 40, an engine oil cooler 50 and a power steering oil cooler 60. Each of the components of the present invention is secured in a compact package for installation in a vehicle such as a HUMMER or the like. By utilizing a modulated, compact design, the present invention may more easily be installed and serviced while significantly reducing heat towards the vehicle's engine and thus increasing horsepower.

B. Radiator

As shown in FIG. 1, the present invention will generally include a vehicle radiator 20 for reducing the heat of engine coolant after it is heated passing through the engine block. Various types of radiators 20 may be utilized with the present invention, and thus the scope of the present disclosure should not be construed as being limited to the particular configuration shown in the figures. Thus, it should be appreciated that various sizes and designs of radiators 20 may be included in the present invention.

Figure 3:
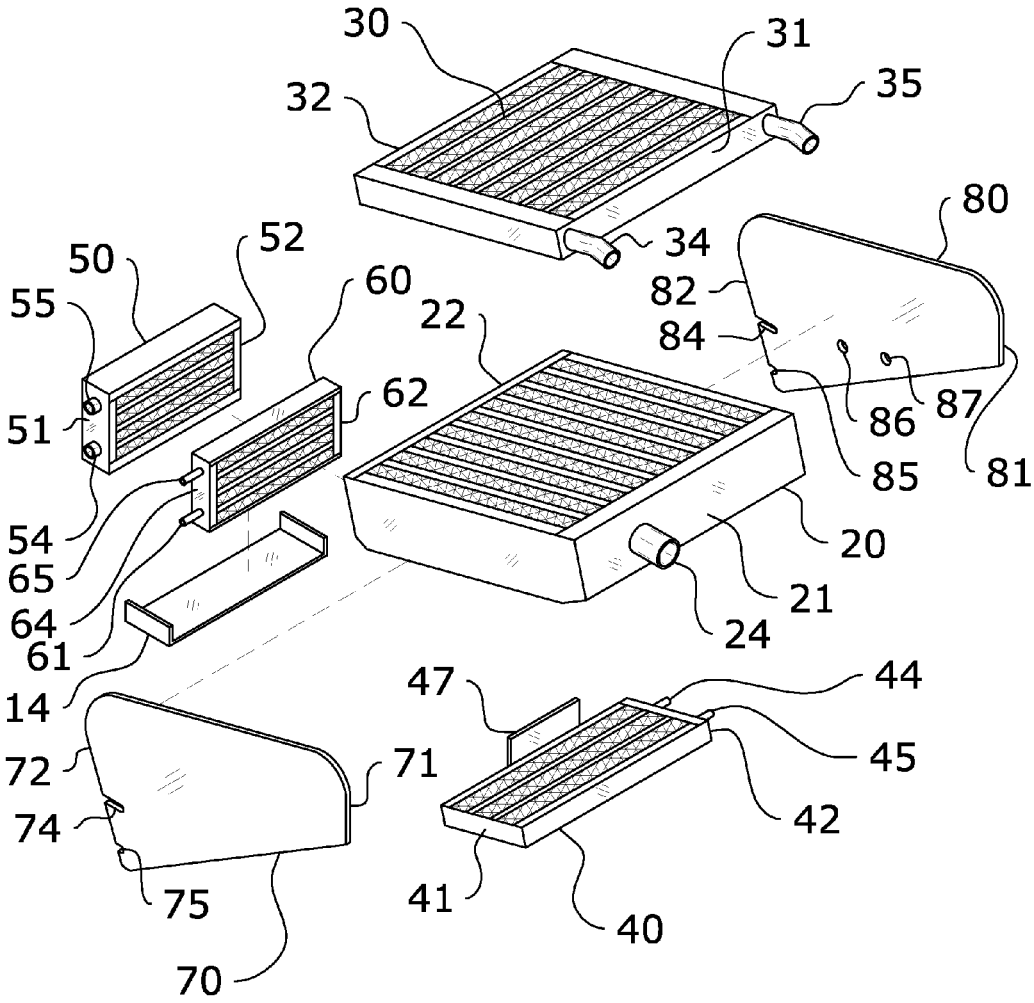
FIG. 3 is an exploded view of the present invention.

As shown in FIG. 3, the radiator 20 of the present invention will generally include a front end 21 and a rear end 22. The front end 21 of the radiator 20 will preferably be positioned facing the front of the vehicle in which the present invention is installed. The radiator 20 will generally include a water inlet 24 and a water outlet 25. Although various configurations may be utilized, FIG. 3 illustrates an embodiment in which the water inlet 24 is positioned on the front end 21 of the radiator 20 and the water outlet 25 is positioned on the lower end of the radiator 20. It is appreciated that various other arrangements may be utilized.

The radiator 20 of the present invention will preferably serve as a central portion of the assembled present invention, wherein it is positioned at the core of the present invention as shown in FIG. 1. The various components of the present invention, including the air charge cooler 30, transmission oil cooler 40, engine oil cooler 50 and power steering oil cooler 60 will be secured and/or positioned around the radiator 20 when the present invention is fully constructed.

C. Air Charge Cooler

The present invention will also generally include an air charge cooler 30 or intercooler which is utilized to cool engine air before it enters the engine to allow for optimal power for the combustion process. Various types of air charge coolers 30 may be utilized with the present invention, and thus the scope of the present disclosure should not be construed as being limited to the particular configuration shown in the figures. Thus, it should be appreciated that various sizes and designs of air charge coolers 30 may be included in the present invention.

The air charge cooler 30 includes a front end 31 and a rear end 32. The air charge cooler 30 will generally include an air inlet 34 and an air outlet 35. In a preferred embodiment as shown in the figures, the air inlet 34 and air outlet 35 are both positioned on the front end 31 of the air charge cooler 30.

As shown in FIGS. 1 and 3, the air charge cooler 30 of the present invention is preferably positioned over the upper end of the radiator 20 and forms the upper surface of the assembled present invention. When assembled as a component of the present invention, the air charge cooler 30 will generally be positioned over the radiator 20 and be sandwiched between the first and second mounting plates 60, 70.

D. Transmission Oil Cooler

The present invention will also generally include a transmission oil cooler 40 as shown in FIG. 3. The transmission oil cooler 40 will act to provide cooling to transmission oil as it passes therethrough. Various transmission oil coolers 40 may be utilized with the present invention, and thus the scope of the present disclosure should not be construed as being limited to the particular configuration shown in the figures. Thus, it should be appreciated that various sizes and designs of transmission oil coolers 40 may be included in the present invention.

As shown in FIG. 3, the transmission oil cooler 40 includes a first side 41 and a second side 42. In a preferred embodiment, an oil inlet 44 and an oil outlet 45 will be positioned on the second side 42 of the transmission oil cooler 40, though it is appreciated that various other configurations may be utilized. The oil inlet 44 and oil outlet 45 will generally extend through a pair of openings 86, 87 in the second mounting plate 80 as shown in FIG. 5.

Figure 4:
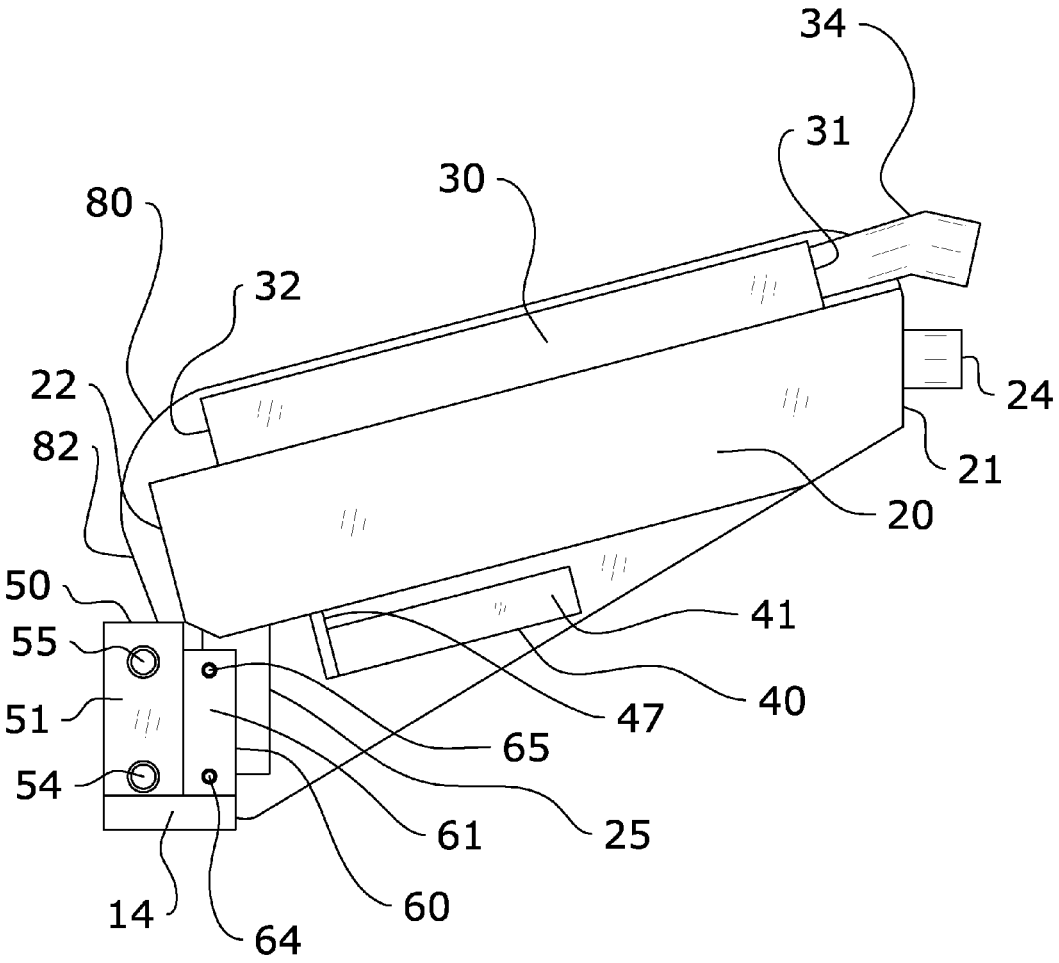
FIG. 4 is a first side view of the present invention.
Figure 5:
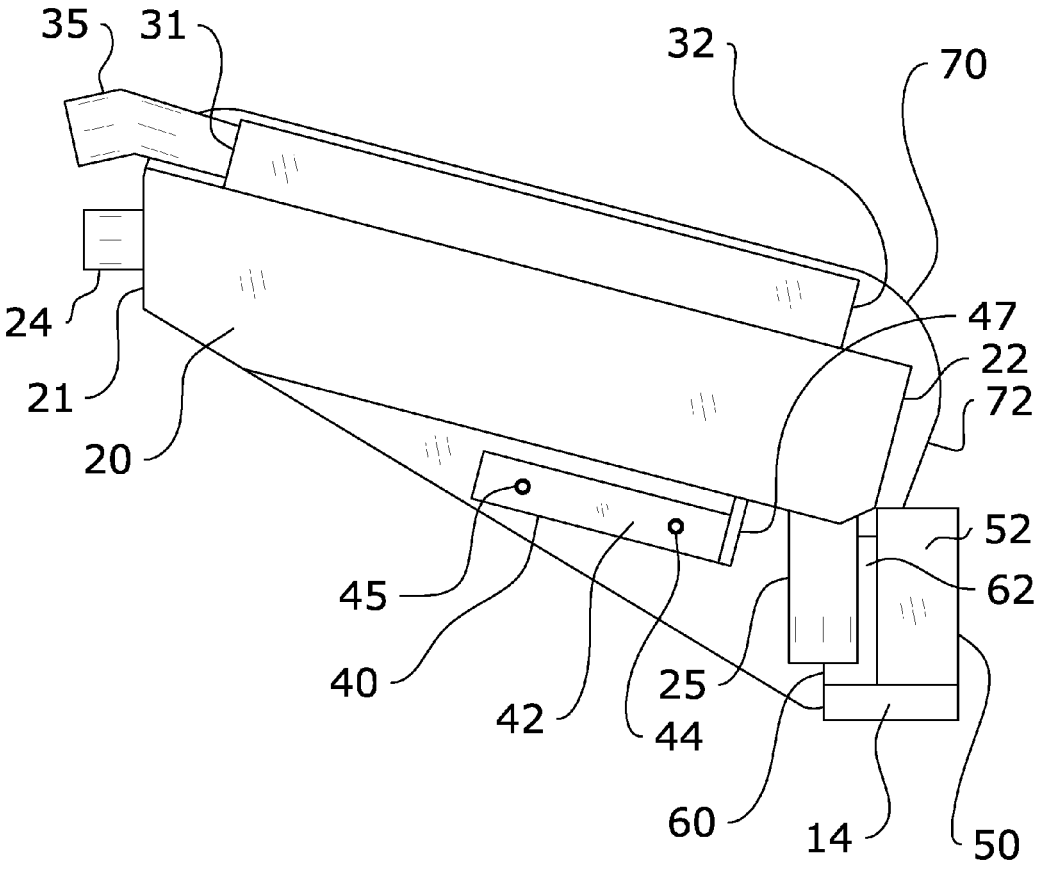
FIG. 5 is a second side view of the present invention.

As best shown in FIGS. 3, 4 and 5, the transmission oil cooler 40 is preferably positioned beneath the radiator 20 and is sandwiched between the first and second mounting plates 70, 80. The transmission oil cooler 40 may also include a deflector 47 positioned on its rear end as shown in FIG. 3. The deflector 47 may be comprised of a plate-like member or other structure which is fixedly or removably secured to the rear end of the transmission oil cooler 40.

E. Engine Oil Cooler

The present invention will also generally include an engine oil cooler 50 as shown in FIG. 3. The engine oil cooler 50 provides additional cooling to engine oil as it passes therethrough. Various engine oil coolers 50 may be utilized with the present invention, and thus the scope of the present disclosure should not be construed as being limited to the particular configuration shown in the figures. Thus, it should be appreciated that various sizes and designs of engine oil coolers 50 may be included in the present invention.

As shown in FIG. 3, the engine oil cooler 50 includes a first side 51 and a second side 52. In a preferred embodiment, an oil inlet 54 and an oil outlet 55 will be positioned on the first side 51 of the engine oil cooler 50, though it is appreciated that various other configurations may be utilized.

As best shown in FIGS. 2-5, the engine oil cooler 50 will preferably be positioned at the rear of the present invention when it is fully assembled. The engine oil cooler 50 will be positioned within a bottom plate 14 which also supports the power steering oil cooler 60 of the present invention. It is also appreciated that the engine oil cooler 50 may be secured to the power steering oil cooler 60 via a bracket.

F. Power Steering Cooler

The present invention will also generally include a power steering cooler 60 as shown in FIG. 3. The power steering cooler 60 provides cooling for power steering fluid as it passes therethrough. Various types of power steering coolers 60 may be utilized with the present invention, and thus the scope of the present disclosure should not be construed as being limited to the particular configuration shown in the figures. Thus, it should be appreciated that various sizes and designs of power steering coolers 60 may be included with the present invention.

As shown in FIG. 3, the power steering cooler 60 includes a first side 61 and a second side 62. In a preferred embodiment, an oil inlet 64 and an oil outlet 65 will be positioned on the first side 61 of the power steering cooler 60, though it is appreciated that various other configurations may be utilized.

As best shown in FIGS. 2-5, the power steering cooler 60 will preferably be positioned at the rear of the present invention when fully assembled. The power steering cooler 60 will be positioned within a bottom plate 14 which also supports the engine oil cooler 50 of the present invention. They may also be secured to each other via a bracket. Generally, the power steering cooler 60 will be sandwiched between the engine oil cooler 50 and the rear end 22 of the radiator 20.

G. Mounting Plates and Shroud

The various components of the present invention are secured within a compact package utilizing a pair of mounting plates 70, 80 and a shroud 12. Preferably, a first mounting plate 70 will be positioned on a first side of the present invention and a second mounting plate 80 will be positioned on a second side of the present invention to secure its various components together in a compact package.

As shown in FIG. 1, the first mounting plate 70 will generally include a front end 71 and a rear end 72, wherein width of the first mounting plate 70 tapers from its rear end 72 to its front end 71. The rear end 72 of the first mounting plate 70 will preferably include a pair of slots 74, 75 through which the oil inlet 64 and oil outlet 65 of the power steering oil cooler 60 will extend when the present invention is assembled as shown in FIG. 1. The first mounting plate 70 may also include a plurality of apertures through which fasteners will be utilized to secure the first mounting plate 70 to the various components of the present invention.

Figure 2:
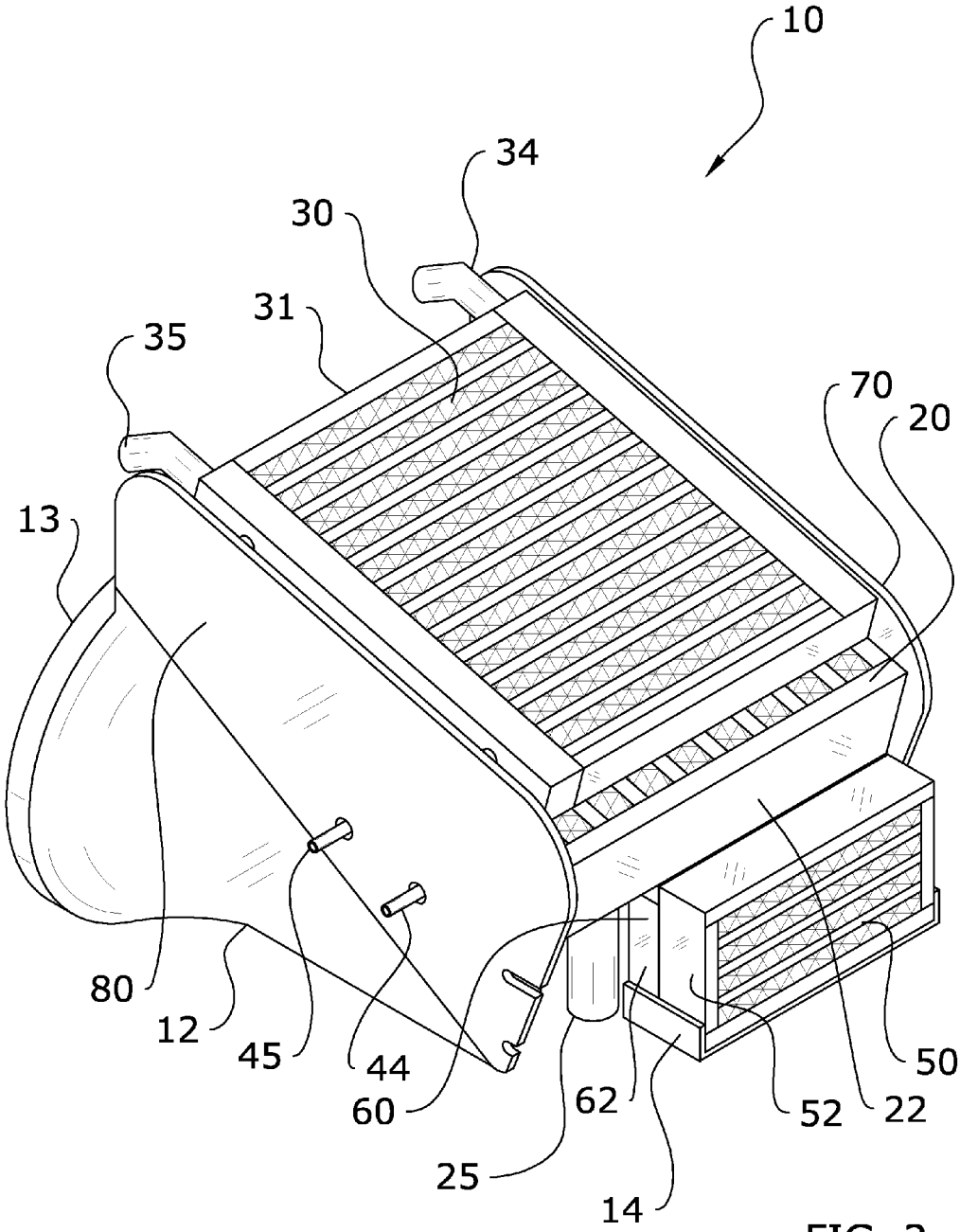
FIG. 2 is a rear upper perspective view of the assembled present invention.

As shown in FIG. 2, the second mounting plate 80 will generally include a front end 81 and a rear end 82, wherein the width of the second mounting plate 80 tapers from its rear end 82 to its front end 81. The rear end 82 of the second mounting plate 80 will preferably include a pair of slots 84, 85 for allowing adaptability to different configurations of the present invention. The second mounting plate 80 also preferably includes a pair of openings 86, 87 through which the oil inlet 44 and oil outlet 45 of the transmission oil cooler 40 extends when the present invention is fully assembled. The second mounting plate 80 may also include a plurality of apertures through which fasteners will be utilized to secure the second mounting plate 80 to the various components of the present invention.

The present invention may also include a shroud 12 which encloses the various components of the present invention. The shroud 12 may be comprised of various configurations, but will preferably be comprised of a shape which allows the present invention to have a largely box-like shape when fully assembled as shown in FIG. 1. The shroud 12 may also include a ring member 13 comprised of a circular rim in which a fan or rotor may be positioned when the present invention is installed in a vehicle. Additionally, a bottom plate 14 may be provided for securing the engine oil cooler 50 and power steering oil cooler 60 to each other and/or to the assembled present invention.

H. Installation of the Present Invention

The present invention may be installed into a vehicle such as a HUMVEE either during initial manufacturing or as an after-market add-on. To install, the various components are arranged as described herein and shown in the figures and interconnected via welding or fasteners. The mounting plates 70, 80 will secure either side of the radiator 20, air charge cooler 30 and transmission oil cooler 40 as shown in FIG. 3. The mounting plates 70, 80 may be welded on or secured via fasteners such as bolts and the like. The engine oil cooler 50 and the power steering oil cooler 60 will be secured to either other via the bottom plate 14 and/or a bracket and will be secured within the mounting plates 70, 80 as shown in FIG. 4. The deflector 47 will be secured to the transmission oil cooler 40 as shown in FIG. 3. The shroud 12 may then be installed to surround and enclose the front and sides of the present invention as shown in FIG. 1. After secured together, the present invention may be positioned within the engine of a vehicle.

The inlet 24 of the radiator 20 is connected to the engine block of the vehicle via a conduit through which a hot water and glycol mixture will enter the radiator 20. The outlet of the radiator 20 is similarly connected to the engine block of the vehicle via a conduit through which a cold water and glycol mixture will re-enter the engine from the radiator 20.

The air inlet 34 of the air charge cooler 30 is connected to the turbo of the vehicle via a conduit through which hot air will enter the air charge cooler 30. The air outlet 35 of the air charge cooler 30 is connected to the engine manifold of the vehicle via a conduit through which cooled air will enter the manifold.

The oil inlet 44 of the transmission oil cooler 40 is connected to the automatic transmission of the vehicle via a conduit through which heated transmission oil will enter the transmission oil cooler 40. The oil outlet 45 is connected back to the automatic transmission. The oil inlet 54 and oil outlet 55 of the engine oil cooler 50 will be connected to the engine block via separate conduits and the oil inlet 64 and oil outlet 65 of the power steering oil cooler 60 will be connected to the power steering pump and case, respectively.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A compact multi-unit vehicle cooling system, comprising:

a radiator;

an air charge cooler;

a transmission oil cooler;

an engine oil cooler;

a power steering oil cooler;

a first mounting plate; and a second mounting plate, wherein said radiator, said air charge cooler, said transmission cooler, said engine oil cooler and said power steering oil cooler are secured between said first mounting plate and said second mounting plate, wherein said second mounting plate includes a first opening and a second opening, wherein said oil inlet of said power steering oil cooler extends through said first opening and said oil outlet of said power steering oil cooler extends through said second opening.

2. The compact multi-unit vehicle cooling system of claim 1, wherein said radiator includes a front end and a rear end, wherein said radiator includes a water inlet and a water outlet, wherein said water inlet is positioned on said front end of said radiator.

3. The compact multi-unit vehicle cooling system of claim 1, wherein said air charge cooler includes an air inlet and an air outlet.

4. The compact multi-unit vehicle cooling system of claim 3, wherein said air charge cooler includes a front end and a rear end, wherein said air inlet and said air outlet are each positioned on said front end of said air charge cooler.

5. The compact multi-unit vehicle cooling system of claim 1, wherein said transmission oil cooler includes an oil inlet and an oil outlet.

6. The compact multi-unit vehicle cooling system of claim 5, wherein said transmission oil cooler includes a deflector secured to a rear end thereof.

7. The compact multi-unit vehicle cooling system of claim 6, wherein said first mounting plate includes a first slot and a second slot, wherein said oil inlet of said transmission oil cooler extends through said first slot and wherein said oil outlet of said transmission oil cooler extends through said second slot.

8. The compact multi-unit vehicle cooling system of claim 1, wherein said engine oil cooler includes an oil inlet and an oil outlet.

9. The compact multi-unit vehicle cooling system of claim 1, wherein said power steering oil cooler includes an oil inlet and an oil outlet.

10. The compact multi-unit vehicle cooling system of claim 1, further comprising a shroud being secured to the bottom edges of said first mounting plate, said second mounting plate and said radiator.

11. A compact multi-unit vehicle cooling system, comprising:

a first mounting plate;

a second mounting plate;

a radiator secured between said first mounting plate and said second mounting plate;

an air charge cooler secured between said first mounting plate and said second mounting plate, wherein said air charge cooler is positioned above said radiator;

a transmission oil cooler positioned between said first mounting plate and said second mounting plate, wherein said transmission oil cooler is positioned below said radiator; and an engine cooler and a power steering cooler secured to each other via a bracket, wherein said engine cooler and said power steering cooler are positioned beneath said radiator and partially between said first mounting plate and said second mounting plate, wherein said first mounting plate includes a first slot and a second slot, wherein an oil inlet of said transmission oil cooler extends through said first slot and wherein an oil outlet of said transmission oil cooler extends through said second slot.

12. The compact multi-unit vehicle cooling system of claim 11, further comprising a shroud being secured to the bottom edges of said first mounting plate, said second mounting plate and said radiator.

13. The compact multi-unit vehicle cooling system of claim 11, wherein said second mounting plate includes a first opening and a second opening, wherein an oil inlet of said power steering oil cooler extends through said first opening and an oil outlet of said power steering oil cooler extends through said second opening.

14. The compact multi-unit vehicle cooling system of claim 11, wherein an inlet of said radiator is connected to an engine block of a vehicle via a first conduit and wherein an outlet of said radiator is connected to said engine block of said vehicle via a second conduit.

15. The compact multi-unit vehicle cooling system of claim 14, wherein an inlet of said air charge cooler is connected to a turbo of said vehicle and wherein an outlet of said air charge cooler is connected to an engine manifold of said vehicle.

16. The compact multi-unit vehicle cooling system of claim 15, wherein an inlet and an outlet of said transmission oil cooler are each connected to a transmission of said vehicle.

17. The compact multi-unit vehicle cooling system of claim 16, wherein an inlet and an outlet of said engine oil cooler are each connected to an engine block of said vehicle.

18. A compact multi-unit vehicle cooling system, comprising:

a first mounting plate;

a second mounting plate;

a radiator secured between said first mounting plate and said second mounting plate, wherein an inlet of said radiator is connected to an engine block of a vehicle via a first conduit and wherein an outlet of said radiator is connected to said engine block of said vehicle via a second conduit;

an air charge cooler secured between said first mounting plate and said second mounting plate, wherein said air charge cooler is positioned above said radiator, wherein an inlet of said air charge cooler is connected to a turbo of said vehicle and wherein an outlet of said air charge cooler is connected to an engine manifold of said vehicle;

a transmission oil cooler positioned between said first mounting plate and said second mounting plate, wherein said transmission oil cooler is positioned below said radiator, wherein said first mounting plate includes a first slot and a second slot, wherein an oil inlet of said transmission oil cooler extends through said first slot and wherein an oil outlet of said transmission oil cooler extends through said second slot, wherein said inlet and said outlet of said transmission oil cooler are each connected to a transmission of said vehicle;

an engine cooler and a power steering cooler secured to each other via a bracket, wherein said engine cooler and said power steering cooler are positioned beneath said radiator and partially between said first mounting plate and said second mounting plate, wherein said second mounting plate includes a first opening and a second opening, wherein an oil inlet of said power steering oil cooler extends through said first opening and an oil outlet of said power steering oil cooler extends through said second opening, wherein said inlet and said outlet of said engine oil cooler are each connected to an engine block of said vehicle;

wherein an inlet of said power steering oil cooler is connected to a power steering pump of a vehicle and wherein an outlet of said power steering oil cooler is connected to a power steering case of said vehicle; and a shroud secured to bottom edges of said first mounting plate, said second mounting plate and said radiator, wherein said shroud includes a ring member.

* * * * *